US006146287A

United States Patent [19]

Rugge et al.

[11] Patent Number: 6,146,287

[45] Date of Patent: Nov. 14, 2000

[54] GOLF CLUB HEAD WITH WEIGHTED SOLE IN STIFFENED REGION

[75] Inventors: Richard L. Rugge, Encinitas; Philippe Besnard, Oceanside; James M. Sieleman; Stephen A. Kraus, both of San Diego, all of Calif.

[73] Assignee: Taylor Made Golf Company, Inc., Carlsbad, Calif.

[21] Appl. No.: 09/201,952

[22] Filed: Dec. 1, 1998

[51] Int. Cl.[7] ..... A63B 53/04

[52] U.S. Cl. ..... 473/334; 473/338

[58] Field of Search ..... 473/324, 335, 473/338, 343, 344, 345, 334

[56] References Cited

U.S. PATENT DOCUMENTS

| | | | |
|---|---|---|---|
| D. 83,088 | 1/1931 | Sussams . | |
| D. 192,515 | 4/1962 | Henrich . | |
| D. 318,701 | 7/1991 | Antonious | D21/214 |
| D. 318,892 | 8/1991 | Antonious | D21/214 |
| 1,913,821 | 6/1933 | Stumpf | 473/338 |
| 2,756,055 | 7/1956 | Bittner | 473/338 |
| 3,126,206 | 3/1964 | Sabia | 273/186 |
| 4,043,563 | 8/1977 | Churchward | 473/338 |
| 4,085,934 | 4/1978 | Churchward | 473/338 |
| 5,004,241 | 4/1991 | Antonious | 273/167 H |
| 5,314,185 | 5/1994 | Gorman | 473/328 |
| 5,967,905 | 10/1999 | Nakahara et al. | 473/345 |

*Primary Examiner*—Kien T. Nguyen
*Attorney, Agent, or Firm*—John L. Rogitz

[57] ABSTRACT

A golf club head for a metalwood includes a body having an upper surface, a central region of which is stiffened by means of two parallel ridges extending perpendicular to the club face. Also, the lower surface of the club head has two ridges to stiffen a central region of the lower surface. A cavity in the lower surface of the club head holds a weight that is collateral with respect to the ridges. The weight does not fill the cavity completely, such that a 0.030" gap borders the weight between the weight and the wall of the cavity.

36 Claims, 2 Drawing Sheets

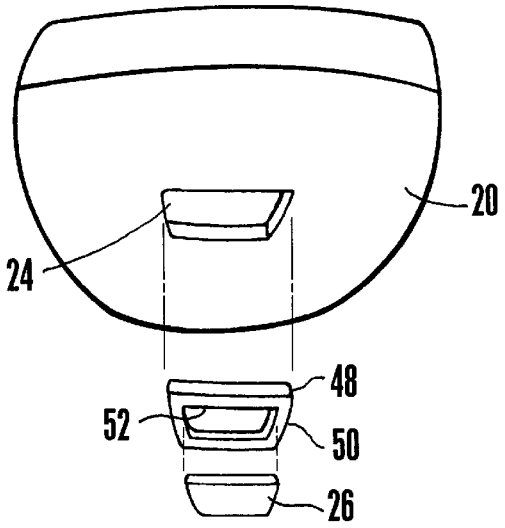
Fig. 4
Fig. 5
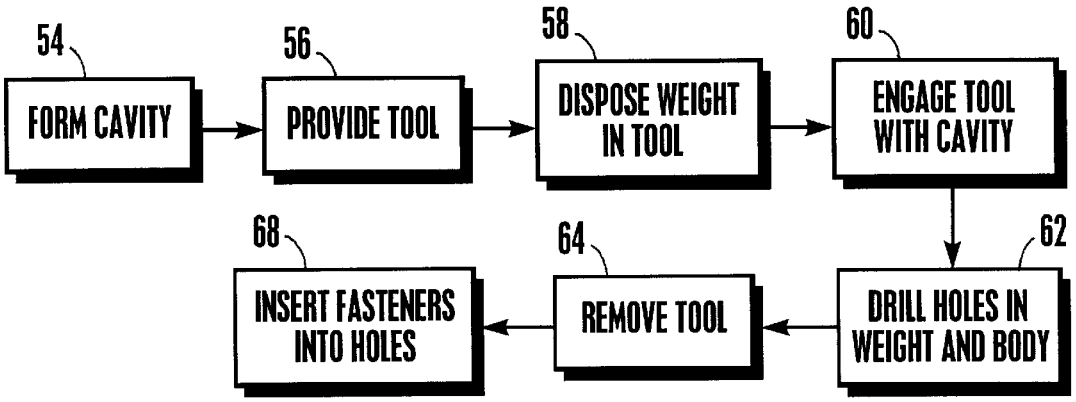

GOLF CLUB HEAD WITH WEIGHTED SOLE IN STIFFENED REGION

FIELD OF THE INVENTION

The present invention relates generally to golf clubs, and more particularly to golf club heads that are weighted for improved balance and enhanced performance.

BACKGROUND

Heavy soles have been provided on golf clubs to lower their center of gravity and thereby improve the balance of the clubs during the stroke. As an example of such a club, U.S. Pat. No. 5,527,034 to Ashcraft et al. discloses a golf club head having an aluminum or brass body and a separate sole that fits into cavity which must be machined into the body. The sole is weighted, that is, the sole is made of even a heavier material than is the body of the club head, thereby lowering the center of gravity of the head.

As recognized by the present invention, not only do weighted club heads exhibit improved balance, but they can also result in a golfer imparting a greater impact on the ball during the stroke than the golfer would otherwise impart with an unweighted club head. This enables the golfer to hit the ball farther than he or she otherwise would, thus improving the golfer's game.

As further recognized herein, however, a golf club head can deform slightly when impacting a golf ball, thereby reducing the energy imparted to the ball by the club, regardless of whether the head is weighted. In other words, the effect of a weighted head in enabling a golfer to hit a ball farther than he or she otherwise would unfortunately is mitigated somewhat by head deformation during the stroke. Fortunately, the present invention recognizes that it is possible to reduce the deformation of a golf club head as it strikes a golf ball.

In addition to the above consideration, weighted soles, such as the one disclosed in the above-mentioned patent, are precisely fitted into a cavity in the bottom of the head. This has two drawbacks. First, precise machining of the weighted sole is required to fit it into the cavity, which entails rather small manufacturing tolerances and concomitant higher manufacturing costs. Second, the thickness of the sole cannot be ascertained once it is disposed in the cavity. As recognized herein, it is desirable to reduce manufacturing tolerances (and, thus, costs), as well as to enable a golfer to easily ascertain the thickness of a weighted sole.

SUMMARY OF THE INVENTION

A golf club head includes a club head body defining an upper surface, a lower surface, and a club face therebetween. At least two opposed parallel ridges are on at least one of the surfaces, and the ridges are perpendicular to the club face. Preferably, both the upper and lower surfaces are formed with ridges. From one perspective, the ridges define respective planes, with each plane passing through the respective ridge and the lower surface. A cavity is formed in the lower surface, and at least one weight is disposed in the cavity. In accordance with the present invention, the weight extends between the planes that are defined by the ridges. Plural fasteners engage the weight to the body.

Preferably, the weight defines a width in the dimension that is parallel to the club face, and the planes of the ridges are parallel to each other. A distance is defined between the planes. The width of the weight can be less than, more than, or equal to the distance between the planes of the upper ridges, but in any case the weight is centered between the upper and lower ridges.

Additionally, the cavity defines a wall, and a gap is defined between the weight and the wall. The gap is at least ten thousandths of an inch wide, and the gap can be at least thirty thousandths of an inch wide.

The golf club head body has a first density and the weight has a second density greater than that of the body. Accordingly, the golf club head body can include a material selected from the group of materials including titanium and aluminum, and the weight can include at least one of: copper, iron, nickel, or tungsten. The golf club head is disclosed in combination with a golf club shaft to establish a golf club.

In another aspect, a golf club head includes a body including an upper surface, at least one stiffened region, and a lower surface engaged with a weight.

In still another aspect, a method for making a golf club includes forming a cavity in a lower surface of a golf club head. The cavity defines a contour. A hollow tool is provided that has the same contour as the cavity, and the tool is closely receivable in the cavity. A weight is disposed in the tool, the tool engaged with the cavity such that the weight is centered in the cavity, and then the weight is fastened to the head.

In yet another aspect, a golf club head includes a body having a lower surface. A cavity is formed in the lower surface, with the cavity defining at least one wall. A weight is disposed in the cavity such that a gap of at least ten thousandths of an inch is established between the weight and the wall.

The details of the present invention, both as to its structure and to its operation, can best be understood by reference to the accompanying drawings, in which like reference numerals refer to like parts, and in which:

BRIEF DESCRIPTION OF THE DRAWINGS

FIG. 4 is a perspective view of the lower surface of the club, in an exploded relationship with the weight and a tool for centering the weight in the cavity; and FIG. 5 is a flow chart of the method steps of the present invention.

DETAILED DESCRIPTION OF THE PREFERRED EMBODIMENT

Figure 1:
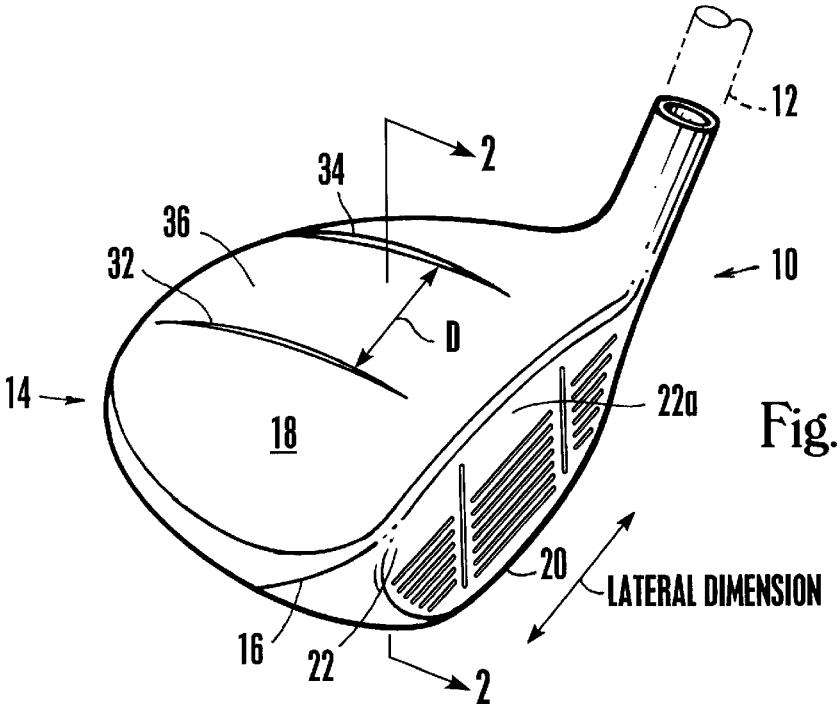
FIG. 1 is a perspective view of the present golf club head, with portions of the shaft broken away and portions of the shaft shown in phantom.
Figure 2:
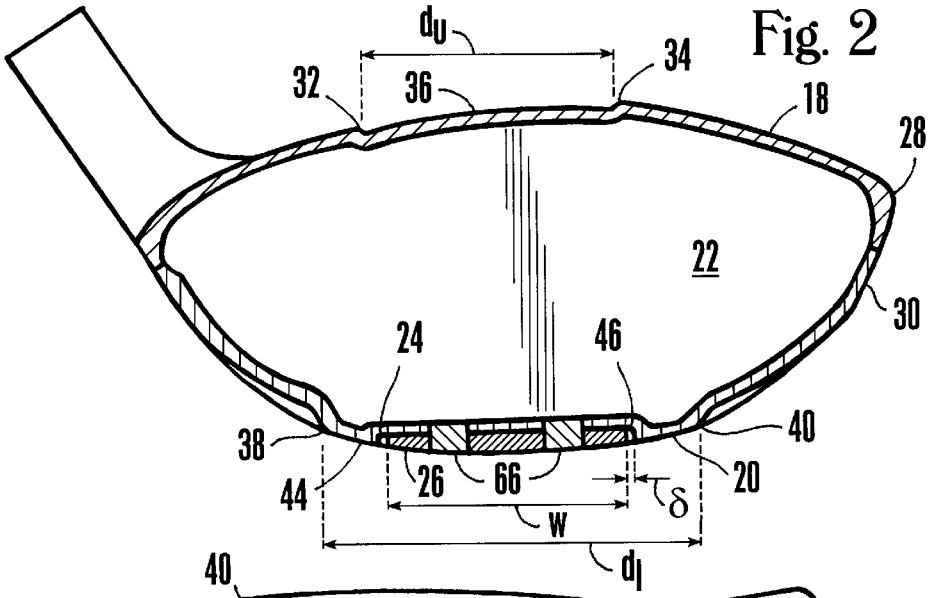
FIG. 2 is a cross-sectional view as seen along the line 2—2 in FIG. 1.

It is to be understood that although FIGS. 1 and 2 depict a specific type of golf club, the following description applies equally to all types of clubs, including putters, irons, and, more preferably, metalwoods.

Now referring to FIGS. 1 and 2, a golf club is shown, generally designated 10, that includes a shaft 12 and a head, generally designated 14 that is attached to the shaft 12 by means known in the art. The head 14 includes a metal body 16 that defines an upper surface 18, a lower surface 20, and a slightly convex club face 22 extending between the surfaces 18, 20. As shown in FIG. 1, the club face 22 defines a lateral dimension, labelled "lateral" in FIG. 1. Also, as best shown in FIG. 2, the lower surface 20 is formed with a cavity 24, and a weight 26 is disposed in the cavity 24. The weight 26 has the same contour as the cavity 24.

In one preferred embodiment, the body 16 is hollow, and is formed by joining an upper metal piece 28 to a lower metal piece 30, although it is to be understood that the body 16 can be made of a single piece or more than two pieces, if desired. The body 16 is made of relatively light and less dense materials, such as titanium or a titanium alloy, magnesium, beryllium, aluminum, aluminum alloy or comparatively less dense steel, while the weight 26 is made from relatively heavy and more dense materials, preferably tungsten alloy, or a copper-based alloy, a nickel-based alloy, or an iron-based alloy such as a comparatively more dense steel.

Preferably, when the golf club head 14 is for a fairway metalwood, the body 16 is made of steel having a density of about seven and nine-tenths grams per cubic centimeter (7.9 g/cc) and a total weight of about between one hundred fifty five and one hundred sixty five grams (155 g–165 g), whereas the weight 26 is made of a tungsten alloy having a density of about ten grams per cubic centimeter (10 g/cc) and a total weight of about fifty grams (50 g). In contrast, when the golf club head 14 is for a driver metalwood, the body 16 is made of a titanium alloy having a density of about four and five-tenths grams per cubic centimeter (4.5 g/cc) and a total weight of about one hundred seventy eight grams (178 g), whereas the weight 26 is made of a tungsten alloy having a density of about ten grams per cubic centimeter (10 g/cc) and a total weight of about eighteen grams (18 g).

With the above disclosure in mind, as shown in FIGS. 1 and 2, two opposed, preferably parallel upper ridges 32, 34 are formed on the upper surface 18, and the upper ridges 32, 34 are perpendicular to the club face 22. An upper stiffened region 36 is defined between the upper ridges 32, 34, it being understood that the region 36 is rendered stiffened relatively more stiff than the regions laterally outside the ridges 32, 34 by means of the cooperation of the upper ridges 32, 34 that rise upwardly relative to the upper stiffened region 36. By "stiffened" is meant that the region 36 is less likely to deform when striking a golf ball than are other regions of the upper surface 18, although the effect of the ridges 32, 34 is to stiffen these other regions somewhat as well, if not to the same degree as the stiffened region 36. As shown, the upper stiffened region 36 is that portion of the upper surface 18 that has the same "lateral" dimension position as does a centrally located "sweet" area 22*a* of the club face 22.

Figure 3:
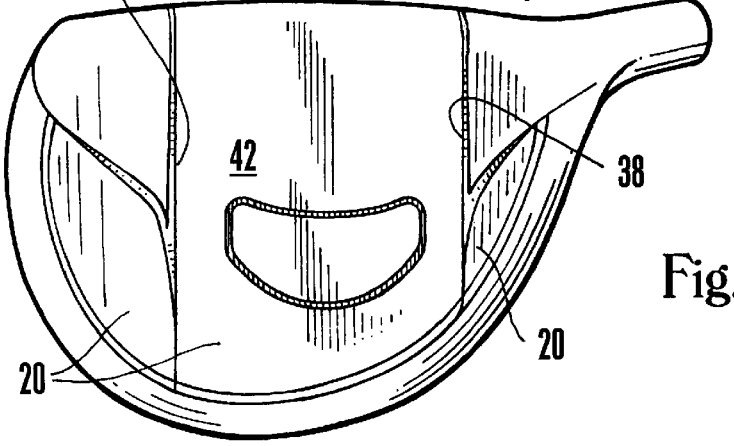
FIG. 3 is a bottom view of the golf club head.

Furthermore, as best shown in FIGS. 2 and 3, two opposed, preferably parallel lower ridges 38, 40 are formed on the lower surface 20, and the lower ridges 38, 40 are perpendicular to the club face 22. A lower stiffened region 42 is defined between the lower ridges 38, 40, it being understood that the region 42 is rendered stiffened by means of the cooperation of the lower ridges 38, 40 that extend toward the upper surface 18 from the lower stiffened region 42. In other words, while the upper stiffened region 36 is somewhat recessed relative to the portions of the upper surface 18 that are lateral to the upper stiffened region 36, the lower stiffened region 42 protrudes slightly beyond the portions of the lower surface 20 that are lateral to the lower stiffened region 42.

The lower stiffened region 42 is that portion of the lower surface 20 that has the same "lateral" dimension position as does a centrally located "sweet" area 22*a* of the club face 22. Accordingly, because the upper and lower stiffened regions 36, 42 represent most of the surface area of the center of the club head 14, the central portion of the club head 14 is stiffened. In the preferred embodiment, while both stiffened regions are centered in the lateral dimension, the distance $d_1$, between the lower ridges 38, 40 is greater than the distance $d_u$ between the upper ridges 32, 34.

In the preferred embodiment, the upper ridges 32, 34 define respective planes, with each plane passing through its respective ridge 32, 34 and the lower surface 20. These planes are more or less perpendicular to the lower surface 20. As can readily be appreciated in reference to FIG. 2, the cavity 24 is formed in the lower surface 20 such that the weight 26 extends between the planes defined by the upper ridges 32, 34.

In accordance with the present invention, the weight 26 is collateral with the stiffened region 36 in the lateral dimension. Stated differently, the weight 26 is centered, in the lateral dimension, with the stiffened region 36 of the upper surface 18, such that a line extending perpendicularly upward from the center of the weight 26 would be midway between the upper ridges 32, 34 when it intersects the upper surface 18. Likewise, it can be readily appreciated that the weight 26 is centered with the lower stiffened region 42.

As intended by the present invention, the weight 26 defines a width "W" in the lateral dimension that is defined by the club face 22. The width "W" can be less than the distance $d_u$ between the upper ridges 32, 34, or greater than the distance $d_u$, or more preferably equal to the distance $d_u$, with the weight "W" in any case most preferably being centered between the upper ridges 32, 34 as described above, for optimum performance. In other words, with the above-described structure, the stiffening cooperation of the upper ridges 32, 34 and lower ridges 38, 40, along with the positioning of the weight 26 between the upper ridges 32, 34 and lower ridges 38, 40, optimally transmits the benefit of the weight 26 during the stroke by reducing the amount of deformation-induced energy dissipation in the weighted part of the club bounded by the ridges of the present invention. Moreover, the upper ridges 32, 34 function as an alignment aid to the golfer, bounding, as they do in the "lateral" dimension, the sweet area 22*a*.

Referring to FIG. 2, the cavity 24 defines a wall 44 that is generally perpendicular to the lower surface 20. A small gap 46 is defined between the weight 26 and the wall 38 along the entire periphery of the weight 26. The gap 46 has a width δ of at least ten thousandths of an inch (0.010"), and preferably a width δ of at least thirty thousandths of an inch (0.030"), plus or minus five thousandths of an inch (±0.005"). With this feature, the weight 26 need not be precisely machined to fit within the cavity 24, but rather can be made with a relatively "sloppy" tolerance, e.g., a tolerance of several mils, and still present a pleasing appearance.

While the weight 26 need not be precisely machined, however, it is desirable from an aesthetic and performance standpoint to center the weight 26 in the cavity 24. To do this, FIG. 4 shows that a hollow tool 48 is provided with an outer periphery 50 having the same contour as the cavity 24 and an inner periphery 52 having the same contour as the weight 26 (and, hence, as the cavity 24). The tool 48 is sized such that it can be closely received in the cavity 24.

The method for centering the weight 26 in the cavity 24 is as follows. After forming the cavity 24 as indicated at block 54 in FIG. 5 and the tool 48 provided as indicated at block 56, the weight 26 is positioned in the tool 48, as indicated at block 58. The tool 48 is next engaged with the cavity 24, as indicated at block 60. Then, holes are drilled in the weight 26 and body 14, as indicated at block 62. The tool 48 is then removed from the cavity 24 as indicated at block 64, and the weight 26 placed back in the cavity 24 with the holes in the body 14 aligned with the holes in the weight 26. Fasteners, such as screws, or, more preferably, rivets 66 (FIG. 2), are then engaged with the holes to hold the weight 26 in the cavity 24, as indicated at block 68 of FIG. 4. The fasteners are polished as necessary to make them flush with the lower surface 20. If desired, a hollow rectangular grip (not shown) can be made integrally with the tool 48 and can extend perpendicularly away from the peripheries 50, 52 for gripping the tool 48 during the above steps.

While the particular GOLF CLUB HEAD WITH WEIGHTED SOLE IN STIFFENED REGION as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. A golf club head, comprising:

a unitary club head body defining an upper surface, a lower surface, and a club face therebetween;

at least two opposed parallel ridges on at least one of the surfaces of the body, the ridges defining respective planes, each plane passing through the respective ridge and the lower surface, wherein the ridges are formed on the lower surface;

a cavity in the lower surface; and at least one weight disposed in the cavity, the weight extending between the planes defined by the ridges.

2. The golf club head of claim 1, wherein the weight defines a width in the dimension parallel to the club face, the planes are parallel to each other, and a distance is defined between the planes.

3. The golf club head of claim 2, wherein the width is less than the distance between the planes.

4. The golf club head of claim 2, wherein the width is equal to the distance between the planes.

5. The golf club head of claim 2, wherein the width is greater than the distance between the planes.

6. The golf club head of claim 1, wherein the cavity defines a wall, and a gap is defined between the weight and the wall.

7. The golf club head of claim 6, wherein the gap is at least ten thousandths of an inch wide.

8. The golf club head of claim 7, wherein the gap is at least twenty thousandths of an inch wide.

9. The golf club head of claim 8, wherein the gap is at least thirty thousandths of an inch wide.

10. The golf club head of claim 1, wherein the golf club head body has a first density and the weight has a second density, and the first density is less than the second.

11. The golf club head of claim 1, wherein the golf club head body includes a material selected from the group of materials including steel, magnesium, beryllium, titanium, and aluminum, and the weight includes at least one of: copper, steel, nickel, or tungsten.

12. The golf club head of claim 11, wherein the golf club head body includes titanium or steel and the weight includes at least tungsten.

13. The golf club head of claim 1, in combination with a golf club shaft to establish a golf club.

14. The golf club head of claim 1, further comprising plural fasteners engaging the weight to the body.

15. The golf club head of claim 1, wherein the ridges are formed on the upper surface.

16. The golf club head of claim 1, further comprising upper ridges formed on the upper surface.

17. The golf club head of claim 1, wherein the ridges establish an alignment aid.

18. A golf club head, comprising:

a unitary body including an upper surface, at least one stiffened region, and a lower surface engaged with a weight;

at least two opposed parallel ridges on the lower surface of the body; and at least two opposed parallel ridges on the upper surface of the body.

19. The golf club head of claim 18, wherein the body includes a club face defining a lateral dimension, and the weight is collateral with the stiffened region in the lateral dimension.

20. The golf club head of claim 19, wherein the ridges on the upper surface establish at least a portion of the stiffened region therebetween, the ridges on the upper surface defining respective planes, each plane passing through the respective ridge and the lower surface;

a cavity formed in the lower surface; and at least one weight disposed in the cavity, the weight extending between the planes defined by the ridges, wherein the weight defines a width in the dimension parallel to the club face, the planes are parallel to each other, and a distance is defined between the planes.

21. The golf club head of claim 20, wherein the width is less than the distance between the planes.

22. The golf club head of claim 20, wherein the width is equal to the distance between the planes.

23. The golf club head of claim 20, wherein the width is greater than the distance between the planes.

24. The golf club head of claim 20, wherein the cavity defines a wall, and a gap is defined between the weight and the wall, the gap being at least ten thousandths of an inch wide.

25. The golf club head of claim 20, wherein the golf club head body includes a material selected from the group of materials including steel, magnesium, beryllium, titanium, and aluminum, and the weight includes at least one of: copper, steel, nickel, or tungsten.

26. The golf club head of claim 18, in combination with a golf club shaft to establish a golf club.

27. A golf club head, comprising:

a unitary body having a lower surface, a cavity being formed in the lower surface, the cavity defining at least one wall;

a weight disposed in the cavity; and at least two opposed parallel ridges on the lower surface of the body.

28. The golf club head of claim 27, wherein the body includes an upper surface and a club face between the upper and lower surfaces, the golf club head further comprising:

at least two opposed parallel ridges on the upper surface, the ridges defining respective planes, each plane passing through the respective ridge and the lower surface, the weight extending between the planes defined by the ridges, the weight defining a width in the dimension parallel to the club face, a distance being defined between the planes.

29. The golf club head of claim 28, wherein the width is less than the distance between the planes.

30. The golf club head of claim 28, wherein the width is equal to the distance between the planes.

31. The golf club head of claim 28, wherein the width is greater than the distance between the planes.

32. The golf club head of claim 27, wherein a gap of at least ten thousandths of an inch is established between the weight and the wall.

33. The golf club head of claim 32, wherein the gap is at least twenty thousandths of an inch wide.

34. The golf club head of claim 27, wherein the golf club head body includes a material selected from the group of materials including steel, magnesium, beryllium, titanium, and aluminum, and the weight includes at least one of: copper, steel, nickel, or tungsten.

35. The golf club head of claim 27, in combination with a golf club shaft to establish a golf club.

36. The golf club head of claim 27, further comprising plural fasteners engaging the weight to the body.

* * * * *